US006803844B2

(12) United States Patent
Bach et al.

(10) Patent No.: US 6,803,844 B2
(45) Date of Patent: Oct. 12, 2004

(54) SWITCHGEAR FOR LOW-VOLTAGE SWITCHING UNITS WITH A LINEARLY DISPLACEABLE CONTACT SUPPORT

(75) Inventors: Michael Bach, Berlin (DE); Detlev Schmidt, Berlin (DE); Michael Sebekow, Berlin (DE); Guenter Seidler-Stahl, Berlin (DE); Ingo Thiede, Berlin (DE); Sezai Tuerkmen, Berlin (DE)

(73) Assignee: Siemens Aktiengesellschaft, Munich (DE)

( * ) Notice: Subject to any disclaimer, the term of this patent is extended or adjusted under 35 U.S.C. 154(b) by 23 days.

(21) Appl. No.: 10/181,735

(22) PCT Filed: Feb. 13, 2001

(86) PCT No.: PCT/DE01/00609

§ 371 (c)(1),
(2), (4) Date: Jul. 22, 2002

(87) PCT Pub. No.: WO01/67477

PCT Pub. Date: Sep. 13, 2001

(65) Prior Publication Data

US 2003/0001701 A1 Jan. 2, 2003

(30) Foreign Application Priority Data

Mar. 9, 2000 (DE) ..... 100 12 605

(51) Int. Cl.[7] ..... H01H 13/04
(52) U.S. Cl. ..... 335/202; 335/132; 335/174
(58) Field of Search ..... 335/165–176, 335/16, 147, 6, 195, 202; 218/22, 154; 200/293–308, 16 R, 16 A–16 D, 526, 529

(56) References Cited

U.S. PATENT DOCUMENTS

| | | | | |
|---|---|---|---|---|
| 3,551,867 A | * | 12/1970 | Ingwersen | 337/63 |
| 3,585,329 A | | 6/1971 | Walker et al. | |
| 3,614,680 A | | 10/1971 | Haydu et al. | |
| 5,899,323 A | * | 5/1999 | Rakus | 200/244 |
| 6,049,051 A | * | 4/2000 | Dosmo et al. | 218/155 |
| 6,225,585 B1 | * | 5/2001 | Turkmen | 200/335 |

FOREIGN PATENT DOCUMENTS

| | | |
|---|---|---|
| DE | 514024 | 11/1930 |
| DE | 1250532 | 9/1967 |
| DE | 1814550 | 1/1971 |
| DE | 2247478 | 4/1974 |
| DE | 3539786 | 5/1987 |
| DE | 4416088 | 6/1995 |
| DE | 29615566 | 2/1998 |
| EP | 0225207 | 6/1987 |
| EP | 0325767 | 8/1989 |

* cited by examiner

*Primary Examiner*—Lincoln Donovan
(74) *Attorney, Agent, or Firm*—Harness, Dickey & Pierce, P.L.C.

(57) ABSTRACT

A switchgear, for low-voltage switching units with a linearly-displaceable contact support, includes a case-like housing with guide grooves, running in the direction of travel of the contact support, in the housing side walls thereof. Suitable projections on the side of the contact support, engage in the grooves, whereby the linear travel of the contact support is achieved. Pivoting contacts are arranged on the contact support as displaceable switch contacts.

28 Claims, 2 Drawing Sheets

SWITCHGEAR FOR LOW-VOLTAGE SWITCHING UNITS WITH A LINEARLY DISPLACEABLE CONTACT SUPPORT

This application is the national phase under 35 U.S.C. § 371 of PCT International Application No. PCT/DE01/00609 which has an International filing date of Feb. 13, 2001, which designated the United States of America and which claims priority on German Patent Application No. 100 12 605.7 filed Mar. 9, 2000, the entire contents of which are hereby incorporated by reference.

FIELD OF THE INVENTION

The invention generally relates to a switching pole for low-voltage switching units having a linearly movable contact support for a movable switching contact. Preferably, it relates to one which interacts with a fixed-position switching contact which is mounted on a connecting rail, and includes a drive apparatus for the movable contact support.

BACKGROUND OF THE INVENTION

Switching units having a switching pole are described, by way of example, in DE 12 50 532 B or DE 18 14 550 C1. These are contactors. Specific features of contactors, which appear to be advantageous, cannot, however, be used without problems in circuit breakers, as will be described in more detail in the following text.

Low-voltage circuit breakers include a number of assemblies which are matched to the different task elements and are connected to one another during production of the circuit breakers. The largest assemblies, or units, in this case form the switching poles, that is to say the contact systems (which are composed of stationary and removable switching contacts) with their supporting insulation and the drive apparatus, which is shared by a number of such contact systems). In this case, the movement sequences which are provided by the drive apparatus are transmitted to the contact systems via a switching shaft which is mounted in a fixed position. For this purpose, the switching shaft, which is mounted such that it can rotate and can be pivoted through a specific angle via a spring store or some other switch drive, is provided with levers which originate from this switching shaft and continue further, via which the individual switching poles, or movable contacts which are arranged on contact supports, are operated. Contact supports such as these have until now generally been mounted in low-voltage circuit breakers such that they can pivot. This results in a relatively high physical shape, with effects on the physical height of the switch enclosure, and in a relatively complicated design.

Such conventional configurations of lever arrangements for transmission of the drive force for low-voltage circuit breakers are described, by way of example, in DE-C 44 16 088 and in EP Patent Application 0 225 207. In the case of contact supports which have a number of parallel contact levers, assembled structures, which can be pivoted by means of a shaft, have always been used until now, in which a body is used only to hold the contact levers, and side walls or levers, generally in the form of metal parts, have been attached to this body at the side, by means of screw connections or in some other way, with these then representing the mounting of the contact support.

A movable contact support of this type has been disclosed in DE 35 39 786 A1. Here, the bearing arms are a component of a bearing bracket, whose dimensions are matched to a holding body for the contact levers. This is a structure comprising a number of metal parts. Movable contact supports are also known which are assembled from a combination of plastic moldings and metal parts. For example, DE-296 15 556 U describes a movable switching contact arrangement for a low-voltage circuit breaker with contact levers and with a contact lever support which holds the contact levers and is mounted by bearing arms at the side such that it can pivot for connection and disconnection. This contact lever support has a center part, which comprises a base body and at least one additional body which can be attached to this base body, with the bearing arms being mounted on the center part, on both sides. Both the movable contact supports which have been mentioned are assembled in a conventional manner from a number of individual components. Furthermore, parasitic voltages can occur in the case of supporting arms composed of metal.

The contactors which were mentioned initially have contact supports which move in straight lines. These are connected to an armature of a drive magnet and contain bridge contacts with associated contact force springs. However, this is completely unusual for circuit breakers. Contact links which have become known for circuit breakers have considerable problems (quite apart from other difficulties that are still to be mentioned) with regard to the dissipation of the switching gases. Although two disconnection points can allow a higher switching rating, two switching chambers are required, by way of example, from which it is necessary to provide dissipation of the switching gases. Particularly in the case of high switching ratings, the primary problem is the dissipation of the switching gases for the second disconnection point. If the contact link is arranged vertically, there are difficulties with the course of the arc, since the switch components are located above the disconnection point. The lower arcing chamber therefore cannot be used.

If the contact link is arranged horizontally, there is a problem in dissipating the switching gases on one side, since this would have to be done to the side on which, in the case of the circuit breakers, their peripheral devices, such as auxiliary and signaling devices, are located. This is extremely disadvantageous. If the switching gases are dissipated to the side, the distances to the side walls of the inset frame are also too small. Furthermore, the guidance of the busbars with respect to the contacts when the contact link is arranged horizontally results in considerable problems. Thus, a vertical arrangement of the contacts might represent the best solution. But, as has already been stated above, this cannot be achieved using a contact link.

Another problem is that the arrangement with a contact link is mechanically unstable. There is no certainty as to which contacts of the link will open first, that is to say where the greater erosion will occur. Considerable technical complexity is involved in designing such contact links reliably, with regard to the contact forces or the simultaneous opening of both contacts. The arrangement of two arcing chambers also represents not inconsiderable additional complexity.

In the case of low-voltage circuit breakers, particularly in the case of devices with a high switching rating, the geometry of the switching pole must be maintained as precisely as possible in order to avoid over designing in widely different ways, and in order to ensure correct operation. This includes exactly ensuring the penetration to achieve the necessary contact force, the contact opening and other parameters. However, this is not feasible with contact links, as has been described above.

Leading and main contacts are required in order to cope with the switching rating, as is disclosed by way of example in FIGS. 9 to 12 in U.S. Pat. No. 3,585,329, which illustrate the profile of the contact movement during disconnection of a switch. In this case, it can be seen that the main contact opens first followed by the auxiliary contact, which indicates that the disconnection arc is transferred from the auxiliary contact to a dissipation lug. This avoids arc formation on the main contact and prevents the main contact from being worn by contact erosion.

This sequence of a switching process can also be found in EP-PS 0325 767 B1, in particular in FIGS. 3 to 5 there. Although this describes a connection process, it is nonetheless clear that the procedure for disconnection takes place in the opposite sequence. Here, too, it can be seen that the erosion of the main contact is avoided by later opening of the contact.

From the problems which have been described, it can be seen that a linearly movable contact support with contact links, as is normal for contactors, cannot be used for low-voltage circuit breakers. In addition to the risk of contact opening as a result of electrodynamic forces, the disadvantage is that only one contact link per pole and, possibly one three-pole contact link support for three contact links per operating rod are feasible, while circuit breakers have individual poles, three or four poles of which can be joined together, depending on the size of the device.

SUMMARY OF THE INVENTION

An object of an embodiment of the invention is to design a switching pole. Preferably, one is designed which is suitable in particular, for low-voltage switching units and has characteristics that have been worked out for this purpose, in comparison to the previously normal physical form.

According to an embodiment of the invention, an object may be achieved by a switching pole including a box-shaped enclosure, through whose enclosure rear wall the connecting rail, which is provided with the fixed-position switching contact, is inserted; and through whose enclosure rear wall a further connecting rail is also passed, by which a pivoting contact, which is arranged on the contact support and is mounted on a shaft, is connected via a flexible conductor as a movable switching contact. Further, interacting guidance units for linearly moving guidance of the contact support may be arranged in the switching pole on opposite walls of the switching pole and on the movable contact support.

An embodiment of the invention surprisingly combines the advantages of linearly movable contact supports and contact levers which are arranged such that they can pivot. It furthermore results in the switching pole being suitable for any type of operation, in particular even linearly acting drives.

U.S. Pat. No. 3,614,680 has already, per se, disclosed a switching pole for a contactor with a box-shaped enclosure, connecting rails which project from it and a pivoting contact. In contrast to the switching pole according to an embodiment of the invention, the pivoting contact is, however, mounted in the enclosure of the switching pole. Thus, there is no separate contact support. This necessitates the armature of the drive magnet being guided with a considerable amount of play in order to allow a connection to the switching contact, which can move in the form of a circular arc. The linear guidance for the contact support in the switching pole according to an embodiment of the invention can be designed such that the enclosure side walls of the switching pole have guide grooves in the movement direction of the contact support, and suitable projections are provided on the sides of the contact support, for sliding in these guide grooves. Furthermore, for the purposes of an embodiment of the invention, the contact support may advantageously be in the form of a plastic molding.

The projections on the sides of the contact support may also be in the form of continuous ribs which run in the movement direction of the contact support.

The movable switching contacts, which are arranged on the contact support, may be mounted on a shaft and may be in the form of pivoting contacts which are known per se, may be supported by contact force springs on the contact support, and have conventional leading contacts, which interact with corresponding mating contacts on the stationary switching contacts, in order to reduce the erosion of the main contacts.

The contact support may be moved in a known manner by a conventional switch drive via an operating element, so that no new technologies, or the complexity associated with them, are required. However, the contact support can be moved in a straight line, and this can be achieved relatively easily by a physically simple technical configuration and is, of course, particularly highly suitable for a linearly acting drive, such as a magnet drive.

Configuration of the contact support in the form of a plastic part avoids parasitic voltages, which can occur due to the metal parts on conventional contact supports that can pivot.

An embodiment of the present invention proposes the combination of a pivoting contact, with all its advantages in a low-voltage circuit breaker, with a linearly movable switch drive, with its advantages. Thus, the conventional highly advantageous arrangement of the connecting rails can be retained while, nevertheless, the advantages of a linearly moving system, with regard to the drive and guidance, can be made use of.

BRIEF DESCRIPTION OF THE DRAWINGS

To assist understanding, the invention will be explained in more detail in the following text with reference to the associated drawings and using a preferred exemplary embodiment, which does not restrict the scope of the patent.

DETAILED DESCRIPTION OF THE PREFERRED EMBODIMENTS

Figure 1:
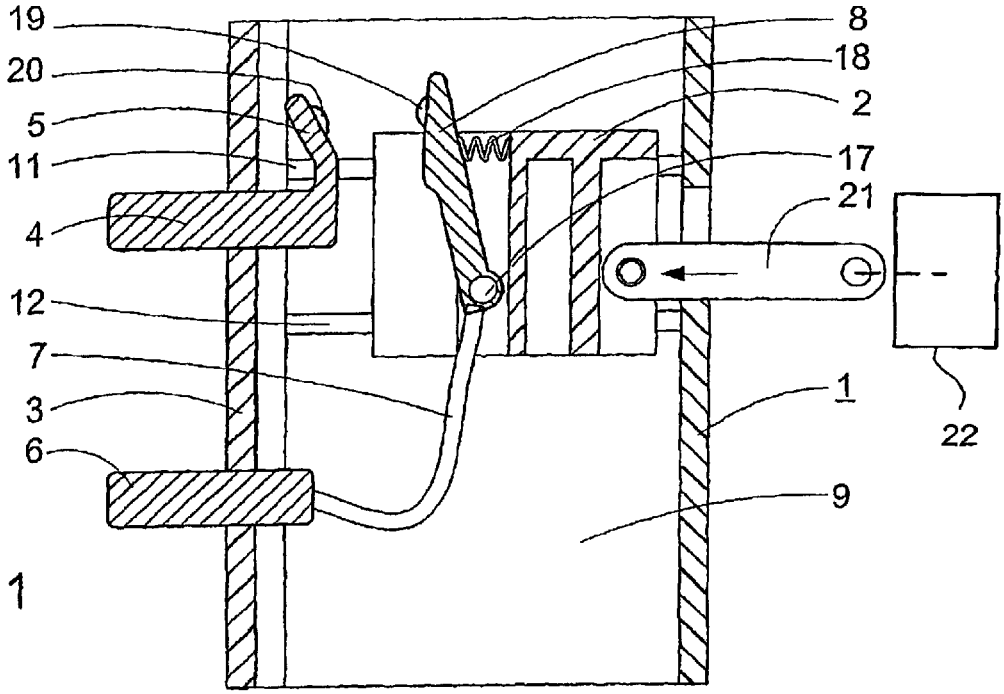
FIG. 1 shows a switching pole for a low-voltage circuit breaker having a linearly moving contact support, in the disconnected state.
Figure 2:
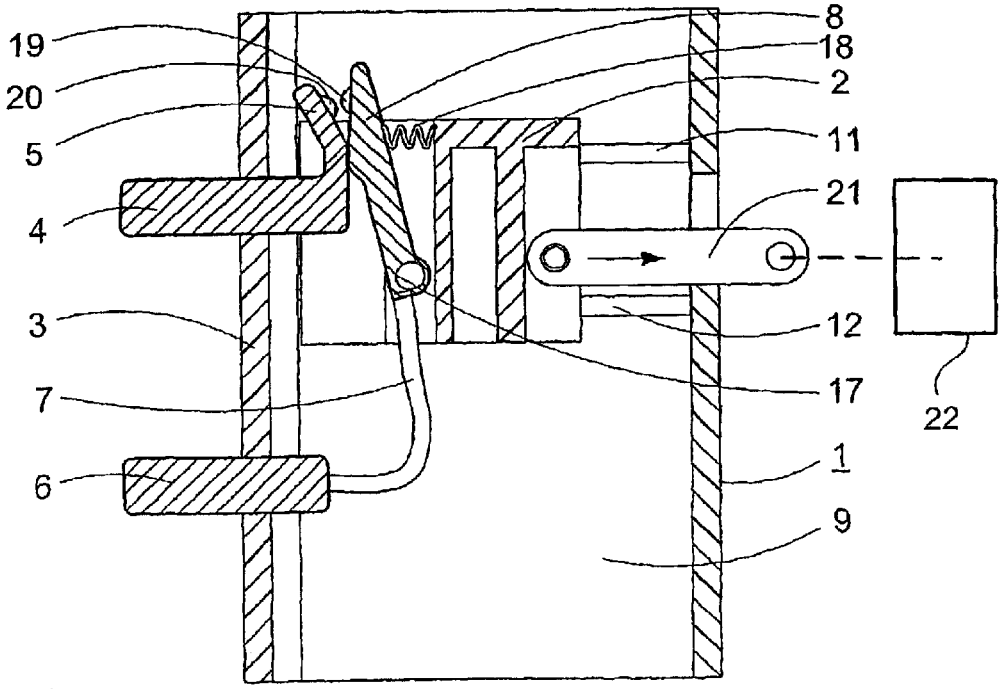
FIG. 2 shows a switching pole for a low-voltage circuit breaker with a linearly movable contact support, in the connected state.

FIGS. 1 and 2 show a switching pole 1 for a low-voltage circuit breaker with a linearly movable contact support 2 in the disconnected state and in the connected state, respectively. The switching pole 1 includes a box-shaped enclosure through which enclosure rear wall 3 the upper connecting rails 4 are inserted, and on which the stationary switching contacts 5 are arranged. Flexible conductor cables 7 are mounted in an electrically conductive manner on the lower connecting rails 6, which are likewise passed through the enclosure rear wall 3, as a connection for the movable switching contacts 8 which are arranged on the movable contact support 2. Guide grooves 11, 12, 13, 14 are provided in the enclosure side walls 9; 10 in order to hold projections 15, 16 which are arranged on the linearly movable contact support 2 and by means of which the contact support 2 can be moved linearly in the enclosure of the switching pole 2, guided by the guide grooves 11, 12, 13, 14. The contact support is in the form of a plastic molding and is fitted with the movable switching contacts 8, which are mounted on a shaft 17, are in the form of pivoting contacts, are supported by means of contact force springs 18 on the contact support 2, and, in the conventional way, have leading contacts 19, which interact with mating contacts 20 on the stationary switching contacts 5, in order to reduce the erosion of the main contacts.

The contact support 2 is moved via an operating element 21 by a switch drive 22 (which is illustrated schematically) in the conventional manner. This operating element 21 results in the contact support 2 being moved in the direction of the arrow in FIG. 1, linearly toward the stationary switching contact 5, until the movable switching contacts 8 come into contact with the stationary switching contacts 5, and the connected state is reached, as shown in FIG. 2. The contact support is moved back to the disconnected position, as shown in FIG. 1, by moving the operating element 21 in the direction of the arrow shown in FIG. 2.

Figure 3:
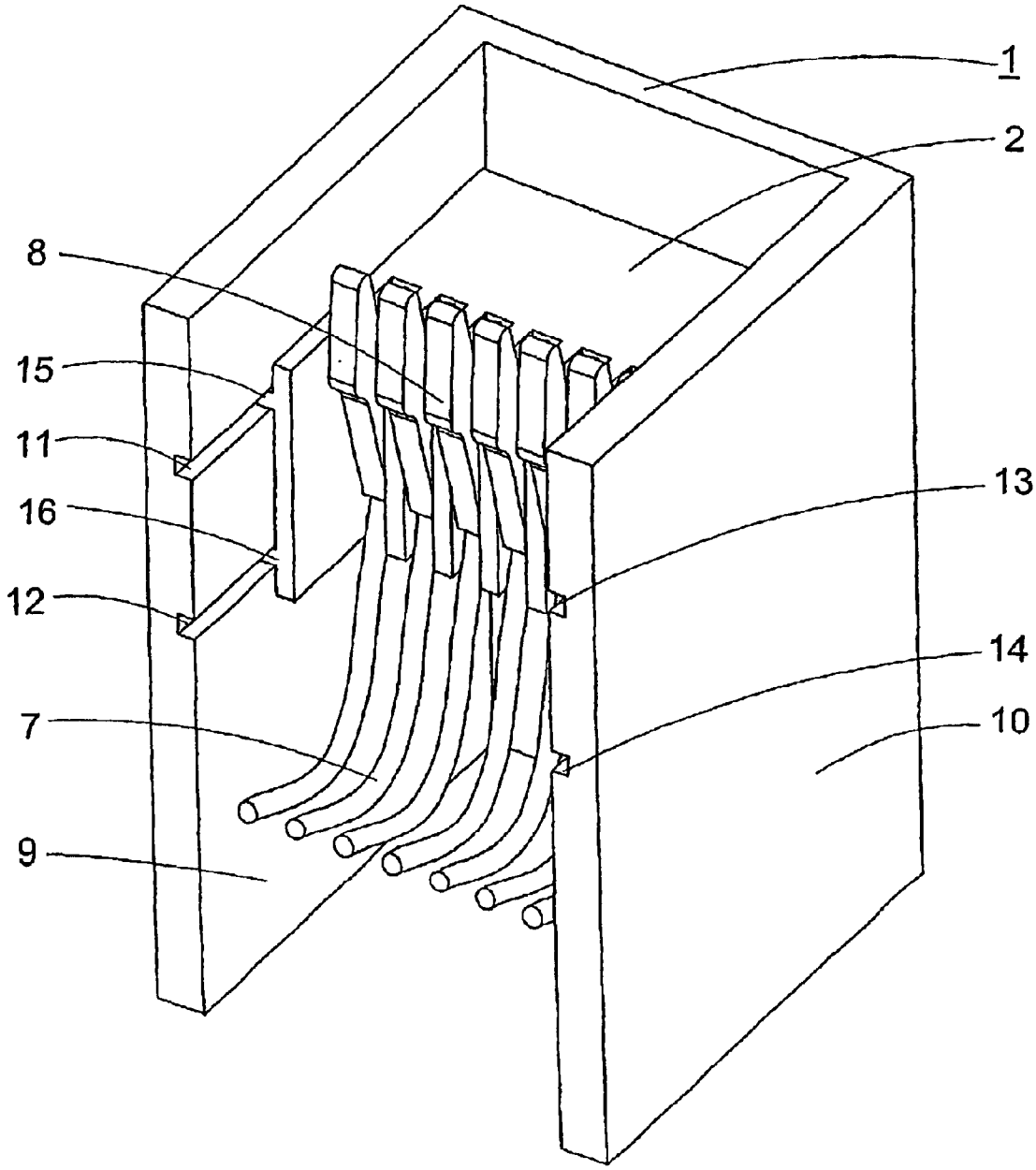
FIG. 3 shows a switching pole for a low-voltage circuit breaker with a linearly movable contact support, illustrated in perspective form with the rear wall removed.

FIG. 3 shows a switching pole 2 for a low-voltage circuit breaker with a linearly movable contact support 2, illustrated in perspective form with the rear wall removed. Guide grooves 11, 12 and 13, 14 are provided in the side walls 9 and 10, in which guide grooves the contact support 2 is guided by the projection 15, 16 in order to produce a linear movement, as has been described with reference to FIGS. 1 and 2. The movable switching contacts 8, which are in the form of switching contacts which can pivot, are arranged on the contact support 2 and are connected by flexible conductor cables 7 to the lower connecting rail 6, which is not illustrated (FIGS. 1 and 2).

An advantage of the solution according to an embodiment of the invention is that the advantages of a linear movement of the contact support can be combined with the advantages of applicability to the pivoting contacts which have been proven in practice and are in the form of a main contact and a leading contact. Furthermore, the space requirement for a linearly movable contact support is less, and its physical design is considerable simpler. In addition, the arc splitters for the arc quenching chambers are not matched to the path of the contact support and are acting more effectively, since the distance between the contact support and the arc quenching chamber is constant throughout the entire movement process. The use of identical arc splitters additionally reduces the range of components.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

List of Reference Symbols

1 Switching pole
2 Contact support
3 Enclosure rear wall
4 Upper connecting rail
5 Stationary switching contact
6 Lower connecting rail
7 Flexible conductor cable
8 Movable switching contact
9 Enclosure side wall
10 Enclosure side wall
11 Guide groove
12 Guide groove
13 Guide groove
14 Guide groove
15 Projection
16 Projection
17 Shaft
18 Contact force springs
19 Leading contact
20 Mating contact
21 Operating element
22 Drive apparatus

What is claimed is:

1. A switching pole for low-voltage switching units including a linearly movable contact support for a movable switching contact, interactable with a fixed-position switching contact mounted on a connecting rail and a drive apparatus for the movable contact support, the switching pole comprising:

a box-shaped enclosure including an enclosure rear wall, through which the connecting rail, provided with the fixed-position switching contact, is provided, and through which a further connecting rail is also provided, by which a pivoting contact, arranged on the contact support and mounted on a shaft, is connected via a flexible conductor as the movable switching contact; and interacting guidance means for linearly moving the contact support, arranged on opposite walls of the enclosure and on the movable contact support.

2. The switching pole as claimed in claim 1, wherein the enclosure side walls include guide grooves in a movement direction of the contact support, provided on the sides of the contact support.

3. The switching pole as claimed in claim 1, wherein the contact support is in the form of a plastic molding.

4. The switching pole as claimed in claim 1, further comprising projections, suitable for sliding in guide grooves of the enclosure side walls, on the sides of the contact support.

5. The switching pole as claimed in claim 1, wherein the movable switching contacts, arranged on the contact support, are mounted on a shaft and are pivoting contacts supported by contact force springs on the contact support.

6. The switching pole as claimed in claim 1, wherein the movable switching contacts arranged on the contact support, are mounted on a shaft and are pivoting contacts including leading contacts, and wherein the stationary switching contacts include corresponding mating contacts.

7. The switching pole as claimed in claim 2, wherein the contact support is in the form of a plastic molding.

8. The switching pole as claimed in claim 4, wherein the projections are in the form of continuous ribs, running in the movement direction of the contact support.

9. The switching pole as claimed in claim 2, further comprising projections, suitable for sliding in guide grooves of the enclosure side walls, on the sides of the contact support.

10. The switching pole as claimed in claim 3, further comprising projections, suitable for sliding in guide grooves of the enclosure side walls, on the sides of the contact support.

11. The switching pole as claimed in claim 4, further comprising projections, suitable for sliding in guide grooves of the enclosure side walls, on the sides of the contact support.

12. The switching pole as claimed in claim 9, wherein the projections are in the form of continuous ribs, running in the movement direction of the contact support.

13. The switching pole as claimed in claim 10, wherein the projections are in the form of continuous ribs, running in the movement direction of the contact support.

14. The switching pole as claimed in claim 11, wherein the projections are in the form of continuous ribs, running in the movement direction of the contact support.

15. The switching pole as claimed in claim 2, wherein the movable switching contacts, arranged on the contact support, are mounted on a shaft and are pivoting contacts supported by contact force springs on the contact support.

16. The switching pole as claimed in claim 3, wherein the movable switching contacts, arranged on the contact support, are mounted on a shaft and are pivoting contacts supported by contact force springs on the contact support.

17. The switching pole as claimed in claim 4, wherein the movable switching contacts, arranged on the contact support, are mounted on a shaft and are pivoting contacts supported by contact force springs on the contact support.

18. The switching pole as claimed in claim 2, wherein the movable switching contacts arranged on the contact support, are mounted on a shaft and are pivoting contacts including leading contacts, and wherein the stationary switching contacts include corresponding mating contacts.

19. The switching pole as claimed in claim 3, wherein the movable switching contacts arranged on the contact support, are mounted on a shaft and are pivoting contacts including leading contacts, and wherein the stationary switching contacts include corresponding mating contacts.

20. The switching pole as claimed in claim 4, wherein the movable switching contacts arranged on the contact support, are mounted on a shaft and are pivoting contacts including leading contacts, and wherein the stationary switching contacts reduce corresponding mating contacts.

21. An apparatus for a low-voltage switching unit, comprising:

a linearly movable contact support for a movable switching contact, wherein the movable switching contact is further pivotably movable about a shaft;

a fixed-position switching contact, wherein the linearly moveable contact support is adapted to linearly move the movable switching contact;

a drive apparatus, adapted to drive the movable contact support linearly; and an enclosure, including a rail provided with the fixed-position switching contact, and including a further rail, connecting the pivotably movable contact via a flexible conductor.

22. An apparatus for a low-voltage switching unit, comprising:

a linearly movable contact support for a movable switching contact, wherein the movable switching contact is further pivotably movable about a shaft; and a fixed-position switching contact, wherein the linearly moveable contact support is adapted to linearly move the movable switching contact; and an enclosure, including a rail provided with the fixed-position switching contact, and including a further rail, connecting the pivotably movable contact via a flexible conductor, wherein the enclosure includes guide grooves, adapted to guide linear movement of the movable contact support, the movable contact support further including projections adapted to travel in the guide grooves.

23. The apparatus of claim 21, wherein the enclosure includes guide grooves, adapted to guide linear movement of the movable contact support, the movable contact support further including projections adapted to travel in the guide grooves.

24. The apparatus of claim 21, further comprising at least one additional movable switching contact, wherein each at least one additional movable switching contact is pivotably movable about the shaft and is adapted to be linearly moveable via the linearly movable contact support.

25. The apparatus of claim 22, further comprising at least one additional movable switching contact, wherein each at least one additional movable switching contact is pivotably movable about the shaft and is adapted to be linearly moveable via the linearly movable contact support.

26. The apparatus of claim 21, further comprising at least one additional movable switching contact, wherein each at least one additional movable switching contact is pivotably movable about the shaft and is adapted to be linearly moveable via the linearly movable contact support.

27. The apparatus of claim 22, further comprising at least one additional movable switching contact, wherein each at least one additional movable switching contact is pivotably movable about the shaft and is adapted to be linearly moveable via the linearly movable contact support.

28. The apparatus of claim 23, further comprising at least one additional movable switching contact, wherein each at least one additional movable switching contact is pivotably movable about the shaft and is adapted to be linearly moveable via the linearly movable contact support.

* * * * *